US011383369B1

(12) United States Patent
Biscardi

(10) Patent No.: US 11,383,369 B1
(45) Date of Patent: Jul. 12, 2022

(54) IRRIGATION EQUIPMENT MULTIPURPOSE TOOL

(71) Applicant: Gregory Biscardi, San Jose, CA (US)

(72) Inventor: Gregory Biscardi, San Jose, CA (US)

( * ) Notice: Subject to any disclaimer, the term of this patent is extended or adjusted under 35 U.S.C. 154(b) by 259 days.

(21) Appl. No.: 16/840,094

(22) Filed: Apr. 3, 2020

(51) Int. Cl.

| | |
|---|---|
| ***B25F 1/00*** | (2006.01) |
| ***B25B 7/02*** | (2006.01) |
| ***B25B 13/48*** | (2006.01) |
| ***B25G 1/08*** | (2006.01) |
| ***B25F 1/04*** | (2006.01) |

(52) U.S. Cl.
CPC ..... *B25F 1/003* (2013.01); *B25B 7/02* (2013.01); *B25B 13/48* (2013.01); *B25F 1/04* (2013.01); *B25G 1/085* (2013.01)

(58) Field of Classification Search
CPC ... B25F 1/003; B25F 1/04; B25B 7/02; B25B 13/48; B25G 1/085
USPC ..... 7/128, 117, 137; 81/490, 177.4; 30/250, 30/92
See application file for complete search history.

(56) References Cited

U.S. PATENT DOCUMENTS 209,587 A * 11/1878 Rose ..... B23D 61/123 30/259
306,986 A * 10/1884 Wirty ..... B25B 7/22 7/137
445,972 A * 2/1891 Caldwell ..... B25F 1/003 7/128
1,446,380 A * 2/1923 De Laney ..... B25H 7/04 33/631
5,546,661 A * 8/1996 Yang ..... A01G 3/081 30/146
7,350,313 B2 * 4/2008 Laurent ..... B23D 29/023 33/666
2009/0044343 A1 * 2/2009 Grave ..... B23D 21/10 7/129
2011/0167612 A1 * 7/2011 Marshall ..... B25B 7/02 29/237

* cited by examiner

*Primary Examiner* — Hadi Shakeri
(74) *Attorney, Agent, or Firm* — Gulf Coast Intelletual Property Group

(57) ABSTRACT

A multi-purpose tool configured to assist in the execution of a plurality of task associated with the maintenance and/or installation of lawn irrigation equipment. The tool of the present invention includes a body wherein the body has an upper arm member and a lower arm member. The upper arm member and lower arm member are integrally formed with a jaw member. Secured to opposing sides of the jaw member are a first retention member and a second retention member wherein the first retention member and second retention member are operable to receive an retain tool implements. A first tool member support arm and a second tool member support arm are movably secured to the jaw member. Secured to the first tool member support arm and second tool member support arm are tool members. Engagement portions are formed in the upper arm member and lower arm member.

6 Claims, 3 Drawing Sheets

IRRIGATION EQUIPMENT MULTIPURPOSE TOOL

FIELD OF INVENTION

The present invention relates generally to tools, more specifically but not by way of limitation, a multi-purpose tool that is configured to assist a user perform a significant portion of activities that are associated with the replacement and maintenance activities of lawn irrigation equipment.

BACKGROUND

As is known in the art, lawn irrigation systems are installed in millions of residential properties and commercial properties. These irrigation systems consist of a plurality of alternate components that include but are not limited to PVC piping, electronic controllers, valves and sprinkler heads. Ensuing the installation of these systems, the systems will require routine maintenance which can involve replacement of one or more of the aforementioned components. By way of example but not by way of limitation, it is routine that sprinkler heads must be replaced as these can often be damaged as a result of shifting soil or as a result of contact with lawn equipment. The sprinkler heads are operably coupled to the PVC pipe network utilizing a union wherein the pipe and the union are underground in addition to the sprinkler head itself for many types of sprinkler heads. In order to facilitate the removal and replacement of a sprinkler head a worker may have to employ the assistance of many different types of tools.

One issue with employing a plurality of tools in executing lawn irrigation systems is the complexity thereof. Various tools must be transported and sorted through so as to perform the various tasks required for lawn irrigation system maintenance. This can range from pliers to open a PVC cement can, screwdrivers, extractor tools and pipe cutting apparatus. The aforementioned is representative of only a portion of the tools that may be required in order to perform maintenance activities on lawn irrigation systems. A single tool that is equipped to assist a user in the execution of most of the activities required during maintenance of lawn irrigation systems is unavailable.

It is intended within the scope of the present invention to provide a multi-purpose tool that is configured to assist in the facilitation of most activities required during execution of maintenance of lawn irrigation systems.

SUMMARY OF THE INVENTION

It is the object of the present invention to provide a multi-purpose tool that is configured to provide the implements necessary to assist a user in performing maintenance of lawn irrigation systems wherein the present invention is embodied in a hand tool configuration.

Another object of the present invention is to provide a tool configured to include the implements required to execute tasks needed to perform lawn irrigation system maintenance and repair wherein the tool of the present invention includes an upper arm member and a lower arm member.

A further object of the present invention is to provide a multi-purpose tool that is configured to provide the implements necessary to assist a user in performing maintenance of lawn irrigation systems wherein the upper arm member and lower arm member are movably coupled to a jaw member.

Still another object of the present invention is to provide a tool configured to include the implements required to execute tasks needed to perform lawn irrigation system maintenance and repair wherein the upper arm member and lower arm member include inner edges wherein a portion of the inner edges are arcuate in form.

An additional object of the present invention is to provide a multi-purpose tool that is configured to provide the implements necessary to assist a user in performing maintenance of lawn irrigation systems wherein the jaw member includes a lower receiving member and a cutting member.

Yet a further object of the present invention is to provide a tool configured to include the implements required to execute tasks needed to perform lawn irrigation system maintenance and repair wherein the jaw member includes on opposing side thereof retention members.

Another object of the present invention is to provide a multi-purpose tool that is configured to provide the implements necessary to assist a user in performing maintenance of lawn irrigation systems wherein the retention members are configured to releasably secure extractor tools therein.

An alternate object of the present invention is to provide a tool configured to include the implements required to execute tasks needed to perform lawn irrigation system maintenance wherein the lower receiving member has a first side and a second side.

Still a further object of the present invention is to provide a multi-purpose tool that is configured to provide the implements necessary to assist a user in performing maintenance of lawn irrigation systems wherein operably coupled to the first side and second side of the lower receiving member are tool implements.

An additional object of the present invention is to provide a tool configured to include the implements required to execute tasks needed to perform lawn irrigation system maintenance wherein the tool implements can further include a support arm member operably coupled thereto.

A further object of the present invention is to provide a multi-purpose tool that is configured to provide the implements necessary to assist a user in performing maintenance of lawn irrigation systems wherein the tool implements secured to the lower receiving member are movably coupled thereto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
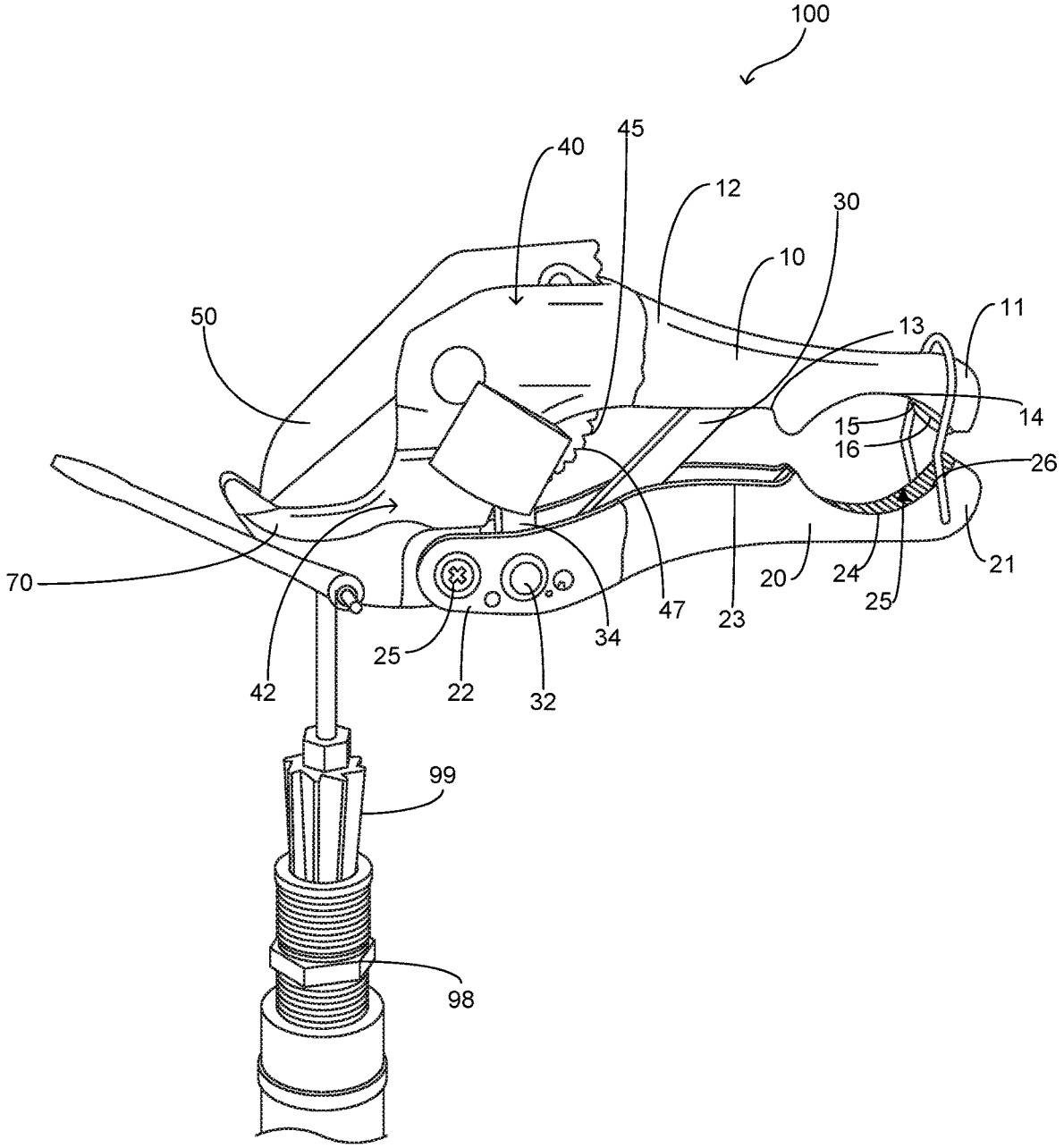
FIG. 1 is a side perspective view of the present invention having a tool implement thereof engaged with an exemplary pipe fitting.
Figure 2:
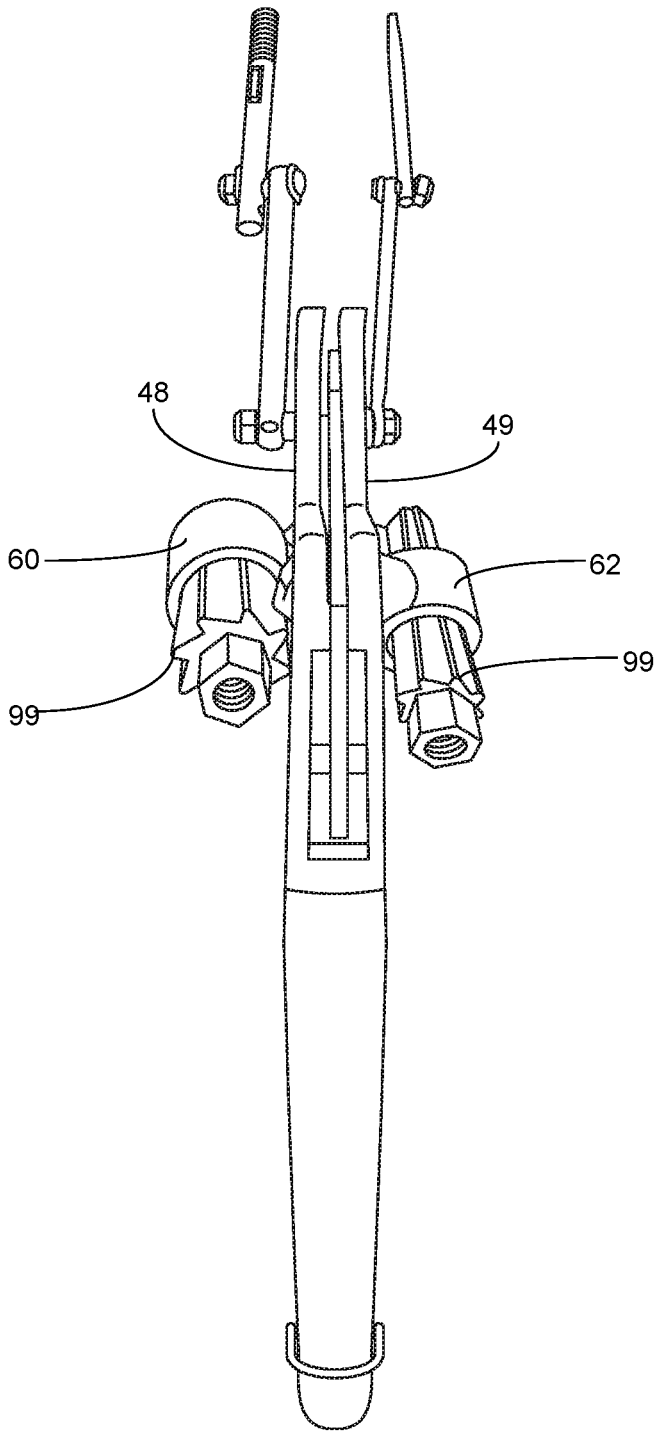
FIG. 2 is top view of a preferred embodiment of the present invention.
Figure 3:
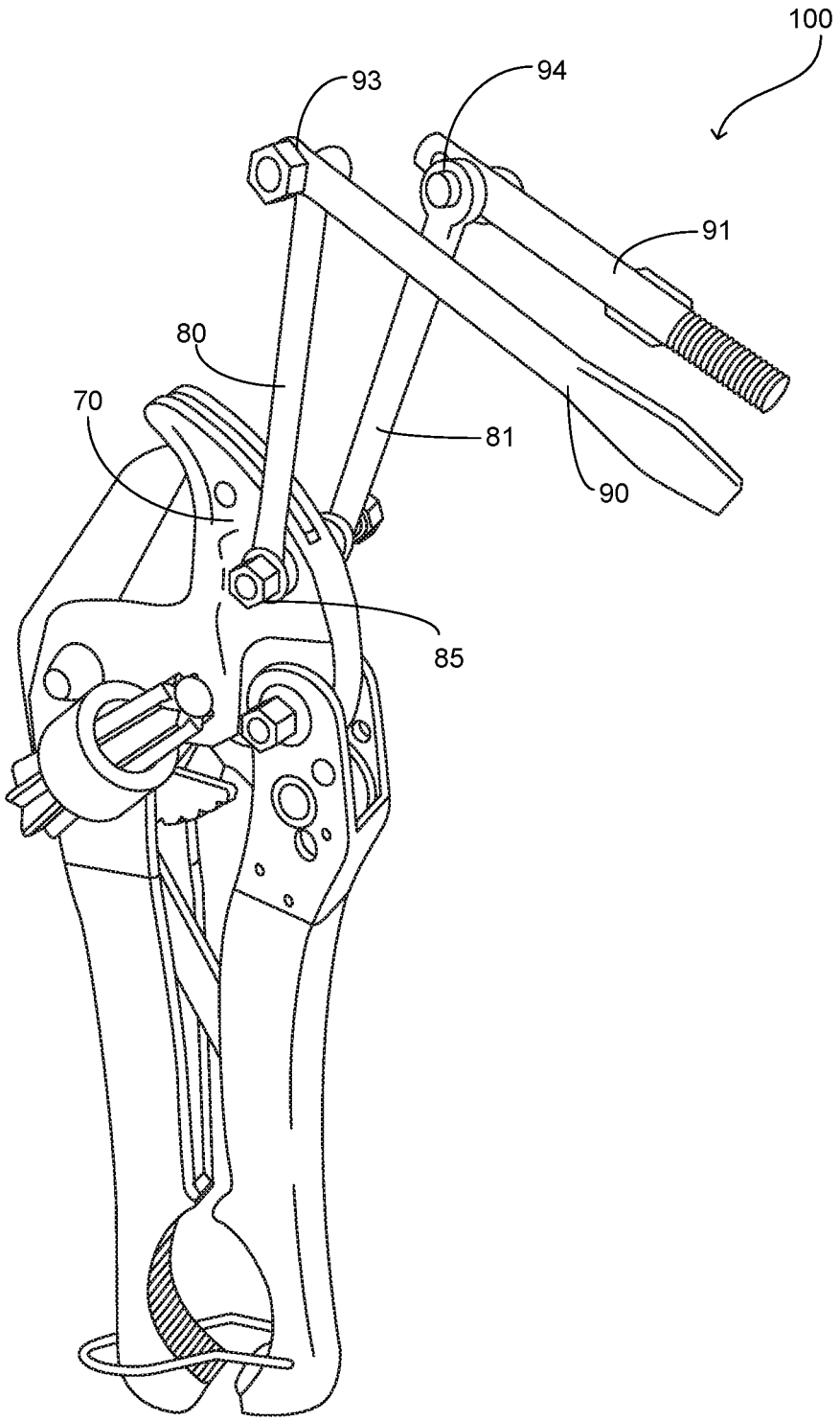
FIG. 3 is a side perspective view of a preferred embodiment of the present invention.

Referring now to the drawings submitted herewith, wherein various elements depicted therein are not necessarily drawn to scale and wherein through the views and figures like elements are referenced with identical reference numerals, there is illustrated a multi-purpose tool 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the multi-purpose tool 100 includes an upper arm member 10 and a lower arm member 20. The upper arm member 10 includes a first end 11 and a second end 12. Second end 12 of the upper arm member 10 is contiguously formed with the jaw member 40 that is further discussed herein. The lower arm member 20 includes first end 21 and second end 22. The lower arm member 20 is movably coupled utilizing fastener 25 to the lower portion 42 of the jaw member 40. The lower arm member 20 pivotally moves on the lower portion 42 of the jaw member 40. It is contemplated within the scope of the present invention the fastener 25 could be various types of conventional fasteners such as but not limited to rivets, pins or bolts. A support arm 30 is operably coupled intermediate the upper arm member 10 and the lower arm member 20. The support arm 30 is movably secured to keeper 32 wherein keeper 32 further has secured thereto a lever arm 34. Lever arm 34 is operably coupled to rear edge 45 of the cutting implement 50, which is further discussed herein.

The upper arm member 10 further includes an inner edge 13. The inner edge 13 includes an engagement portion 14 that is arcuate in form. The engagement portion 14 includes a gripping surface 15 that has gripping members 16 formed thereon. The lower arm member 20 includes an inner edge 23 wherein the inner edge 23 further includes an engagement portion 24 that is arcuate in form and proximate the first end 21. The engagement portion 24 includes a gripping surface 25 having gripping members 26 formed thereon. The engagement portion 14 of the upper arm member 10 and the engagement portion 24 of the lower arm member 20 are axially aligned so as to be facing each other. The engagement portion 14 and engagement portion 24 are configured to assist a user in grasping and opening a bottle of PVC cement or similar item. The gripping surfaces 15,25 and gripping members 16,26 provide an enhanced friction on the PVC cement bottle to ensure the assistance in the opening thereof. It is contemplated within the scope of the present invention that gripping surfaces 15, 25 and gripping members 16,26 could be manufactured with various different materials and textures in order to achieve the desired objective stated herein.

The jaw member 40 includes a first side 48 and a second side 49. Secured to the first side 48 is a first retention member 60 and secured to the second side 49 is the second retention member 62. The first retention member 60 and second retention member 62 are secured to the jaw member 40 utilizing suitable durable techniques such as but not limited to welding. The first retention member 60 and second retention member 62 are identically constructed wherein each is ring shaped being hollow having openings at opposing ends. The first retention member 60 and second retention member 62 are configured to releasably secure exemplary implements 99 therein. The exemplary implements 99 illustrated herein are pipe extractors wherein an exemplary use thereof is illustrated in FIG. 1 submitted herewith. As is known in the art, pipe extractors 99 are utilized to engage pipe unions 98 and the like when alternate tools cannot be engaged therewith in scenarios such as but not limited to the pipe unions 98 being underground. The first retention member 60 and second retention member 62 have a narrowing diameter that facilitates the releasably securing of the exemplary implements 99. While not illustrated herein, it is contemplated within the scope of the present invention that the first retention member 60 and second retention member 62 could have disposed on the interior surface thereof rubber or a similar material that would further facilitate the securing of the exemplary implements therein.

The support arm 30 and lever arm 34 are configured to provide operation of the cutting implement 50 during movement of the upper arm member 10 and lower arm member 20. The lever arm 34 is operably engaged with rear edge 45 wherein the rear edge 45 includes notches 47 formed thereon. The cutting implement 50 includes a cutting edge (not particularly illustrated herein) that is configured to cut through materials such as but not limited to PVC pipe. During the cutting process, a PVC pipe is biased against the lower receiving portion 70 and the cutting implement 50 is moved downward thereagainst in a stepped movement wherein the stepped movement is controlled by the lever arm 34 engaging the notches 47. The aforementioned provides enhanced leverage so as to facilitate successful cutting of a PVC pipe or other material.

Secured to the first side 48 and second side 49 are tool support arms 80, 81. The tool support arms 80, 81 are movably secured with keeper 85. It is contemplated within the scope of the present invention that the keeper 85 could be manufactured from a variety of alternate mechanical fasteners that facilitate the movable coupling of the tool support arms 80, 81. Secured to the movable support arms 80, 81 are tool members 90,91. The tool members 90,91 are secured to tool support arms 80,81 using fasteners 93,94. Fasteners 93, 94 are configured to provide a movable coupling between the tool members 90,91 and the tool support arms 80,81. It is contemplated within the scope of the present invention that the fasteners 93,94 could be constructed from various different types of mechanical fasteners. As is illustrated herein in FIG. 1, it is contemaplted within the scope of the present invention that the multi-purpose tool 100 could be provided without the tool support arms 80,81 wherein the tool members 90,91 are directly movably coupled to the jaw member 40 proximate the lower receiving portion 70.

While the tool members 90, 91 are illustrated herein as being a flat head screwdriver and a threaded bolt operable to couple to the exemplary implements 99 for operation thereof, it is contemplated within the scope of the present invention that the tool members 90,91 could be provided in alternate configurations.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A multi-purpose tool configured to assist a user in performing tasks related to maintenance and installation of lawn irrigation equipment wherein the multi-purpose tool comprises:

a body, said body having an upper arm member and a lower arm member, said upper arm member and said lower arm member being movably coupled, said upper arm member having a first end and a second end, said upper arm member having an inner surface, said lower arm member having a first end and a second end, said lower arm member having an inner surface, said inner surface of said upper arm member and said inner surface of said lower arm member facing each other, said inner surface of said upper arm member having an engagement portion, said engagement portion of said upper arm being arcuate in shape, said inner surface of said lower arm member having an engagement portion, said engagement portion of said lower arm member being arcuate in shape, said engagement portion of said upper arm member and said engagement portion of said lower arm member being axially aligned, said engagement portion of said upper arm member and said engagement portion of said lower arm member configured to grasp opposing sides of an annular top of a container, said upper arm member and said lower arm member having a support arm operably coupled therebetween, said upper arm member and said lower arm member further having a lever arm wherein said lever arm is operably coupled between said lower arm member and a rear edge of a cutting implement;

a jaw member, said jaw member being contiguously formed with said body, said jaw member having a lower receiving portion, said jaw member having a first side and a second side, said jaw member having the cutting implement, said cutting implement operable to cut PVC pipe, said cutting member being movably coupled to said lower arm member;

a first retention member, said first retention member being secured to said first side of said jaw member, said first retention member being annular in shape having a hollow passage therethrough, said first retention member configured to receive a tool implement therein and releasably therein;

a first tool member support arm, said first tool member support arm being movably secured to said first side of said jaw member, said first tool member support arm having a first end and a second end, said first end of said first tool member support arm movably coupled to said lower receiving portion of said jaw member; and a first tool member, said first tool member being movably coupled to said second end of said first tool member support arm, said first tool member extending outward from said first tool member support arm.

2. The multi-purpose tool as recited in claim 1, and further including a second tool member support arm, said second tool member support arm being movably secured to said second side of said jaw member, said second tool member support arm having a first end and a second end, said first end of said second tool member support arm movably coupled to said lower receiving portion of said jaw member.

3. The multi-purpose tool as recited in claim 2, and further including a second retention member, said second retention member being secured to said second side of said jaw member, said second retention member being annular in shape having a hollow passage therethrough, said second retention member configured to receive and retain a tool implement therein.

4. The multi-purpose tool as recited in claim 3, and further including a second tool member, said second tool member being movably coupled to said second end of said second tool member support arm, said second tool member extending outward from said second tool member support arm.

5. The multi-purpose tool as recited in claim 4, wherein the first retention member and second retention member are tapered in shape.

6. The multi-purpose tool as recited in claim 5, wherein the engagement portion of the upper arm member and the engagement portion of the lower arm member further include gripping members formed thereon.

* * * * *